United States Patent [19]

Westra et al.

[11] 4,432,671

[45] Feb. 21, 1984

[54] SUCTION ANCHOR AND METHOD OF INSTALLING A SUCTION ANCHOR

[75] Inventors: Simon Westra, The Hague; Johannes R. Hogervorst, Rijswijk, both of Netherlands

[73] Assignee: Shell Oil Company, Houston, Tex.

[21] Appl. No.: 323,792

[22] Filed: Nov. 23, 1981

[30] Foreign Application Priority Data

Apr. 2, 1981 [NL] Netherlands ..... 8101640

[51] Int. Cl.[3] ..... E02D 7/24

[52] U.S. Cl. ..... 405/226; 114/296; 405/248

[58] Field of Search ..... 405/224, 226, 228, 248; 37/62, 63; 114/296

[56] References Cited

U.S. PATENT DOCUMENTS

| | | | |
|---|---|---|---|
| 983,808 | 2/1911 | Christiansen | 405/226 |
| 3,263,641 | 8/1966 | Stimson | 114/296 |
| 3,496,900 | 2/1970 | Mott et al. | 114/296 |
| 3,965,687 | 6/1976 | Shaw | 405/226 |
| 4,036,161 | 7/1977 | Nixon | 405/226 X |
| 4,318,641 | 3/1982 | Hogervorst | 405/224 |

*Primary Examiner*—David H. Corbin

[57] ABSTRACT

A problem which sometimes occurs is that the plug of bottom material which enters the interior of a suction anchor during installation of the anchor may disturb the pumping process, since the reduced pressure may cause expansion of the said plug, the result being that the anchor does not reach the desired depth in the water-bottom. According to the invention this problem is solved by removing the upper part of said plug from said interior by introducing water into said interior, forming a mixture of bottom particles and water and removing the mixture formed from the said interior.

10 Claims, 5 Drawing Figures

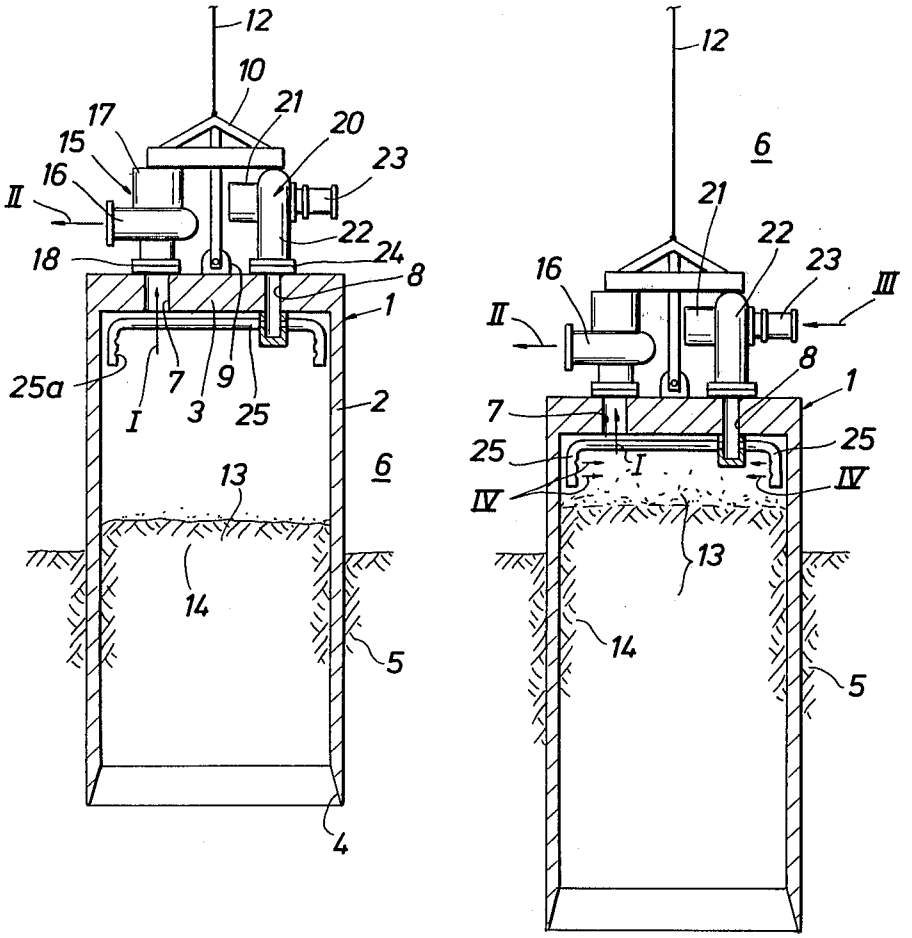
FIG. 1
FIG. 2
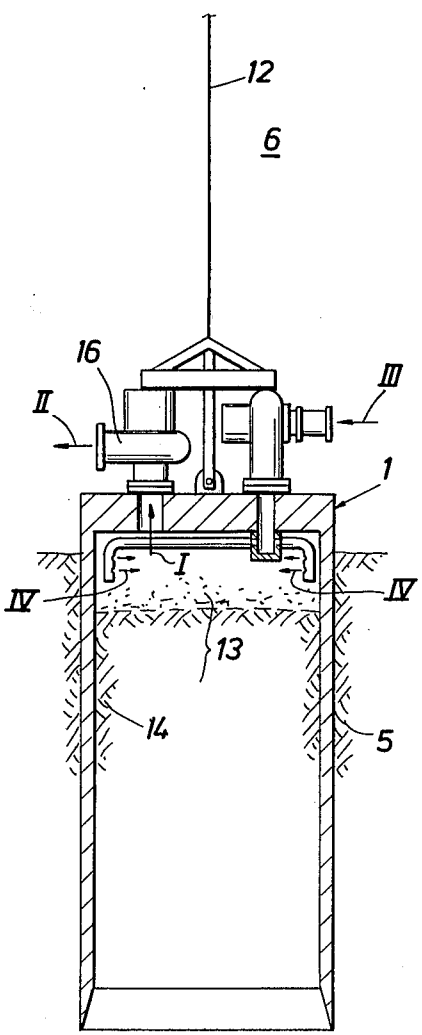
FIG. 3
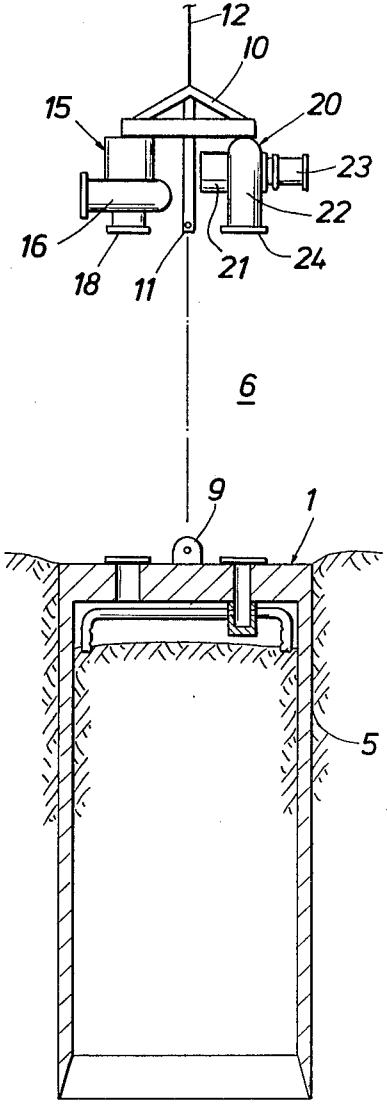
FIG. 4

SUCTION ANCHOR AND METHOD OF INSTALLING A SUCTION ANCHOR

The invention relates to an improved method of installing a suction anchor in the bottom of a body of water.

BACKGROUND OF THE INVENTION

It is often desirable to install a suction anchor in the waterbottom in order to use it for the anchoring of various structures, such as for example floating drilling platforms, floating production platforms, floating tension leg platforms, various types of ships and single buoy mooring systems for loading and unloading tankers, or, for example, for the staying by means of guy cables of various structures, such as for example a free-standing marine conductor.

This application is related to U.S. Ser. No. 99,240, filed Nov. 30, 1979 now U.S. Pat. No. 4,318,641 wherein it is taught to install a suction anchor in the waterbottom by reducing the pressure in the interior of the suction anchor by pumping water therefrom. Similar but different structures are shown in U.S. Pat. Nos. 3,411,473; 3,496,900 and 4,029,039.

A problem which sometimes occurs during the installation by means of this method is that the plug of bottom material which enters the interior of the suction anchor, may disturb the pumping process since the reduced pressure may cause expansion of the plug of bottom material.

It is an object of the invention to provide an improved method of installing a suction anchor in the bottom of a body of water.

SUMMARY OF THE INVENTION

Therefore the method according to the invention comprises lowering the anchor to the bottom, reducing the pressure in the interior of the anchor by removing water therefrom, so as to cause the anchor to penetrate into the bottom and a plug of bottom material to enter into the said interior, removing the upper part of the said plug from the said interior by introducing water into the upper part of said interior in a turbulent manner, eroding the top of the plug so as to create a mixture of bottom particles and water, and removing the mixture formed from the upper part of said interior.

A suction anchor adapted to be installed in the bottom of a body of water by means of the above improved method comprises according to the invention pumping means for reducing the pressure in the interior of the anchor, for introducing water into the upper part of the said interior and for removing a mixture of bottom particles and water from the said interior, said anchor furthermore comprising an inlet for introducing water into the upper part of the said interior and an outlet for removing water or bottom particles and water from the said interior.

BRIEF DESCRIPTION OF THE DRAWING

The invention will now be explained with reference to the drawings relating to some possible embodiments of the invention, wherein.

FIG. 1 shows a vertical cross sectional view of a first possible embodiment of the suction anchor according to the invention, at the moment that it has penetrated about halfway into the waterbottom.

FIG. 2 shows a vertical cross sectional view of the suction anchor of FIG. 1, at the moment the plug of bottom material has reached the upper part of the interior chamber of the anchor and the flushing away of earth or bottom particles from the upper part of the plug has just started FIG. 3 shows a vertical cross sectional view of the suction anchor of FIG. 1, at the moment that bottom particles are flushed away from the top part of the plug of bottom material.

FIG. 4 shows a vertical cross sectional view of the suction anchor of FIG. 1, at the moment that it has penetrated entirely into the waterbottom.

DESCRIPTION OF A PREFERRED EMBODIMENT

Figure 5:
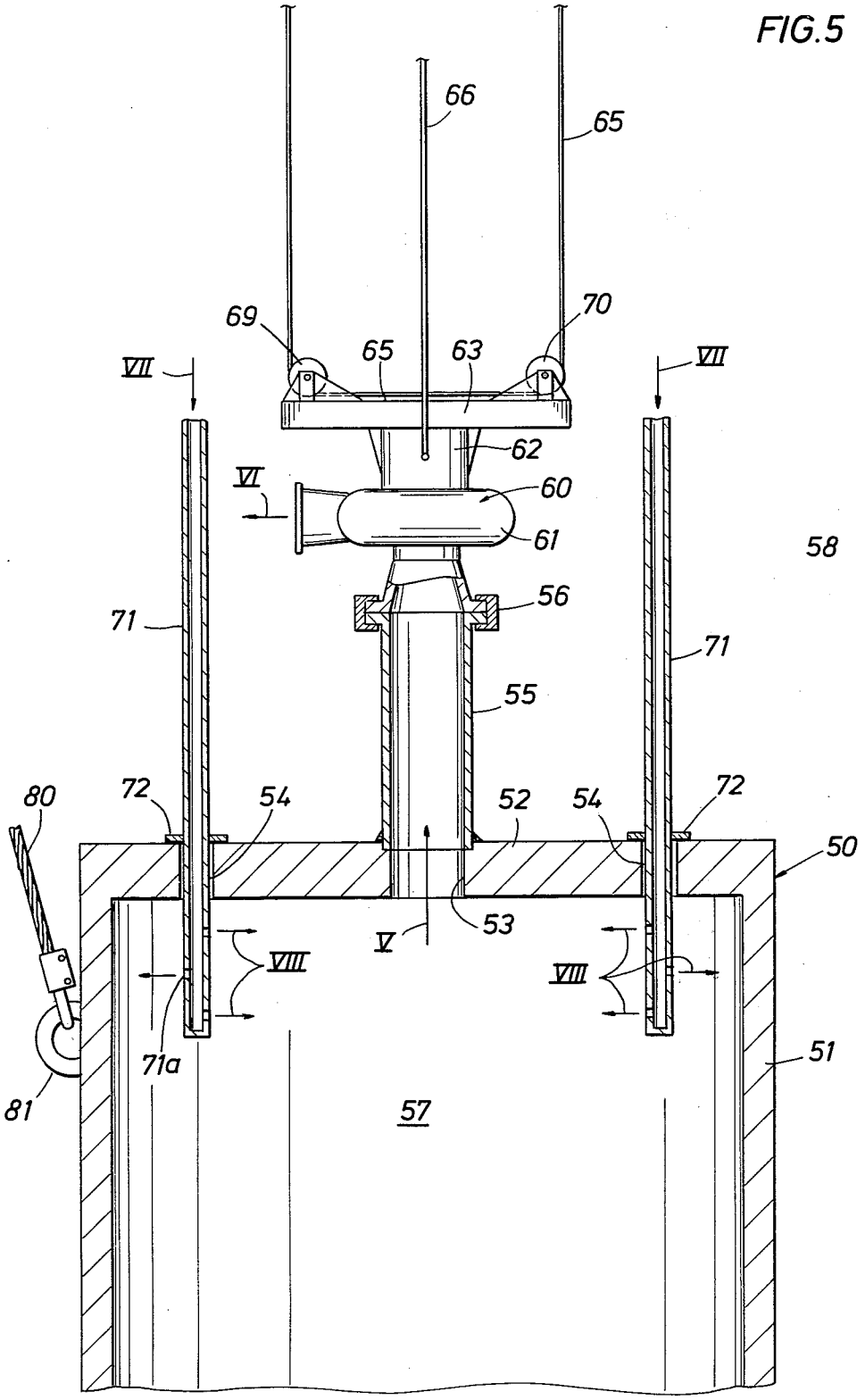
FIG. 5 shows a vertical cross sectional view of a second possible embodiment of the suction anchor according to the invention.

The embodiment of the suction anchor for carrying out the method according to the invention as shown in FIGS. 1 to 4 is generally indicated by the reference numeral 1. A tubular element 2, for example made of steel is closed at its upper end by means of a cap 3. The lower end of the tubular element 2 is open and is provided with a cutting edge 4 which enables the suction anchor 1 to penetrate into the bottom 5 of a body of water 6.

The cap 3 is provided with an outlet 7 and an inlet 8. Pumping means 15 are connected to the outlet 7 by means of a releasable coupling 18, which may be a conventional remotely controlled releasable coupling. The pumping means 15 comprise a pump 16, adapted to a pump a mixture of bottom particles and water, which pump 16 is driven by a remotely controlled motor 17.

Pumping means 20 are connected to the inlet 8 by means of a releasable coupling 24. The pumping means 20 comprise a pump 22, which is driven by aremotely controlled motor 21, and a remotely controlled valve 23, which valve is arranged in the suction passage of the pump 22.

The pumping means 15 and the pumping unit 20 are secured to a frame 10. The frame 10 is provided with a remotely controlled releasable hook 11, which cooperates with an eye 9 secured to the suction anchor 1.

The frame 10 is connected to a hoisting cable 12, which is suspended from a vessel (not shown) floating at the surface of the body of water 6. Power transmission are provided in or on cable 12 or, alternatively, a string of unbilical cables (not shown) is suspended from the vessel adjacent to the hoisting cable 12 for operating the motors 17 and 21, the couplings 18 and 24, the hook 11 and the valve 23.

The suction anchor 1 is installed in the bottom of the body of water in the following manner.

The suction anchor 1 is lowered from a floating vessel (not shown) by paying out the hoisting cable 12. During the lowering of the anchor, the pumping means 15 and the pumping means 20 are not in action. When the cutting edge 4 of the tubular anchor 2 contacts the bottom 5, the hoisting cable 12 is slackened somewhat so as to allow the cutting edge 4 to penetrate into the bottom 5 over a small distance under the weight of the suction anchor 1, in order to form a seal around the base of the tubular element 2.

Then, with the valve 23 in the closed position, the driving motor 17 is started, which causes the pump 16 to evacuate water from the interior 13 of the anchor 1, so that the pressure within the anchor 1 is reduced. The pump 16 removes the water from the interior 13 through the outlet 7 as indicated by arrow I and passes the water to the exterior of the anchor as indicated by arrow II.

In this manner a positive pressure difference is created between the water 6 outside the anchor 1 and the interior 13 of the anchor 1. This pressure difference causes a gradual penetration of the anchor 1 into the bottom 5, while a plug 14 of bottom material enters the interior 13 gradually.

FIG. 1 shows the position wherein the anchor 2 has penetrated about halfway into the bottom 5 and the plug 14 of bottom has reached the middle part of the anchor 1.

FIG. 2 shows the position wherein the anchor 1 has penetrated more than halfway into the bottom 5. In that position the plug of bottom material 14 has reached the top wall 3 of the anchor 1 and may cause blockage of the outlet 7 and of the pump 16. The top of the plug 14 reaches the top wall 3 at an early stage since the reduced pressure in the interior 13 causes the plug 14 to expand. In order to prevent said blockage, at this moment the value 23 is opened and the driving motor 21 is started with causes the pump 22 introduce water from the exterior into the inlet 8 as indicated by arrow III. From the inlet 8 the water introduced is distributed through jetting tubes 25, which may by provided with ports 25*a*, into the upper part of the interior 13 as indicated by arrows IV.

The water introduced through the jetting tubes 25 erodes the top part of the plug 14 and converts it into a mixture of bottom particles, and water.

The mixture of bottom particles and water is removed from the interior 13 by means of the pump 16 which passes the mixture via passage 7 (indicated by arrow I) and to the exterior of the anchor 1, as indicated by arrow II. Pumps 16 and 22 are preferably operated simultaneously.

The introduction of water into the interior 13 by pump 22 decreases the pressure difference between the exterior and the interior 13 of the anchor 1. The resulting pressure difference may be sufficient to cause a further penetration of the anchor 1 into the bottom 5. If this pressure difference is not sufficient, the penetration of the anchor 1 may be continued after the upper part of the plug 14 has been removed. For this purpose the pump 22 is put out of operation, the valve 23 is closed and the pump 16 is put into operation so that in the interior 13 a pressure is created which is sufficiently low to cause further penetration of the anchor.

FIG. 3 shows the position wherein the anchor 1 has penetrated almost entirely into the bottom 5.

FIG. 4 shows the situation wherein the anchor 1 has reached the desired penetration depth in the bottom 5. At this moment the pump driving motors 17 and 21 are switched off so that the pumping process is stopped.

The power-actuatable couplings 18 and 24 and the hook 11 are remotely released so that the pumping means 15, the pumping means 20 and the frame 10 are disconnected from the anchor 1.

Then the frame 10, the pumping means 15 and the pumping means 20 are raised to the water surface by hauling in the hoisting line 12 and taken aboard of the vessel (not shown) at the surface of the water 6.

FIG. 5 shows another possible embodiment of a suction anchor for carrying out the method according to the invention.

In this embodiment the upper portion of a suction anchor 50 (partly shown) comprises a tubular element 51, which is open at the lower end and which is closed at the upper end by means of a cap 52. The cap 52 is provided with an outlet 53 and with inlets 54. A pipe 55 mounted on the anchor 50 forms a fluid passage which is in communication with the outlet 53. Pumping means 60 are connected to the upper end of the pipe 55 by means of a releasable coupling 56, which is preferably power-actuated for remote operation.

The pumping means 60 comprise a pump 61, adapted to pump a mixture of bottom particles and water, which pump 61 is driven by a motor 62 adapted to be remotely controlled from a vessel (not shown) by means of a power transmission umbilical cable 66.

The pumping means 60 are secured to a frame 63 which is suspended from the floating vessel by means of hoisting line 65 which passes along the pulley-sheaves 69 and 70. Jetting tubes, which may be provided with discharge or jet ports 71*a*, 71 pass through each inlet 54, each tube 71 being secured to the anchor 50 by means of a flange 72.

The suction anchor according FIG. 5 is installed as follows. The auction anchor 50 is lowered from the vessel to the waterbottom by paying out the hoisting cable 65. When the suction anchor 50 has reached the waterbottom, the cable 65 is slackened somewhat in order to allow the tubular element 51 to penetrate into the waterbottom over a small distance under the weight of the whole anchor 50. Then the motor 62 is started by supplying the necessary energy via the umbilical cable 66, which causes the pump 61 to remove water from the interior 57 of the anchor 50 as indicated by arrow V to the exterior 58 as indicated by arrow VI. In this manner a positive pressure difference is created between the exterior 58 and the interior 57 of the anchor 50. Said pressure difference causes water to flow from the exterior of the anchor 50 via the jetting tubes 71 as indicated by arrows VII into the interior 57 as indicated by arrows VIII. This introduction of water causes a decreased resulting pressure difference between the exterior 58 and the interior 57 of the anchor 50.

The flow restriction of the jetting tubes 71 is high, and the resulting pressure difference is sufficient to cause the anchor 50 to penetrate into the waterbottom.

When the top of the plug of bottom material, which enters into the interior 57 during the penetration process, has reached the upper part of the interior 57, bottom particles are flushed away from the top of the plug by the waterflows in the direction of arrows VIII. The mixture of bottom particles and water as formed is removed from the interior 57 through the outlet 53 as indicated by arrow V to the exterior 58 as indicated by arrow VI.

When the suction anchor 50 has penetrated into the waterbottom to the desired depth, the driving motor 62 is switched off and the coupling 56 is released. Then the frame 63 together with the pumping means 60 are raised to the water surface by hauling in the hoisting cable 65, and taken aboard of the floating vessel. An anchor line or cable 80 may be connected to a pad eye 81, mounted on the anchor wall, before or after the section anchor is installed by the present invention.

A suction anchor, installed in the bottom of a body of water in the manner according to the invention can be used for various purposes. If it is provided with an anchor cable, it can for example be used for the mooring of a ship, for anchoring a floating production- or drilling platform, so as for example a so-called tension leg platform, for anchoring a single buoy mooring system for loading or unloading tankers.

The said tubular element can also be used as an envelope for protecting the well head and/or the upper part of an oil- or gas well in the seabed, or for anchoring a pipeline to the seabed, or for the staying by means of gay cables of various structures, such as for example a freestanding marine conductor.

We claim as our invention:

1. A method of installing in the bottom of a body of water a suction anchor having an open bottom and a closed top and being provided with fluid inlet and outlet ports in communication between the inside and outside of the anchor near the top thereof, said method comprising lowering the anchor to the bottom, reducing the pressure in the interior of the anchor by removing water therefrom, causing the anchor to penetrate into the bottom, causing a plug of bottom material to enter into and extend substantially through the said interior, eroding the upper part of the said plug from the said interior before it closes the inlet and outlet ports by introducing water into the upper part of said interior in a turbulent manner, so as to create a fluid mixture of bottom particles and water, and removing the mixture formed from the upper part of said interior.

2. The method as claimed in claim 1, wherein the water is introduced into the said interior by pumping means.

3. The method as claimed in any one of the claims 1–2, wherein the mixture of bottom particles and water is removed from the said interior by pumping means.

4. A suction anchor having a closed top, side wall means forming an open interior chamber, and a downwardly directed open end at the bottom of said anchor adapted to be installed in the bottom of a body of water with an earth core extending upwardly into said interior chamber, comprising first pumping means carried by said anchor for reducing the pressure in the interior chamber of the anchor, second pumping means having discharge means operatively connected to said anchor for introducing water into the upper part of the said interior and for eroding the top of the earth core and forming and removing a mixture of bottom particles and water from the said interior chamber, said anchor furthermore including fluid inlet means connected to the discharge means of said second pumping means adjacent the top of said anchor in communication between the interior chamber and the space outside the anchor for introducing water under pressure into the upper part of the said interior chamber, fluid discharge conduit means fixedly mounted to the interior of said anchor in fluid communication with said fluid inlet means thereof, said conduit means having a discharge end terminating near the top of said interior chamber for discharging water under pressure into the upper part of the interior chamber against the earth core formed therein, and fluid outlet means adjacent the top of said anchor in communication between the interior chamber and the space outside the anchor for removing water or bottom particles and water from the said interior.

5. The suction anchor as claimed in claim 4, including valve means in said inlet means.

6. The suction anchor as claimed in claim 4, wherein the inlet is connected to a pumping unit for introducing water into the upper part of the said interior.

7. The suction anchor as claimed in claim 6, wherein the pumping unit for introducing water into the upper part of the said interior includes a suction passage which is in communication with the water outside the anchor.

8. The suction anchor as claimed in claim 6, wherein said second said pumping means is mounted on the anchor.

9. The suction anchor as claimed in claim 8, a remotely-actuatable releasable coupling connects at least one of the said pumping units to the anchor.

10. The suction anchor as claimed in claim 4, wherein the inlet is provided with at least one jetting tube arranged in the upper part of the said interior.

* * * * *